United States Patent [19]

Beckmann

[11] 4,443,955

[45] Apr. 24, 1984

[54] METHOD AND INSTALLATION FOR COOLING HOT BULK MATERIAL

[75] Inventor: Georg Beckmann, Jacquingasse, Austria

[73] Assignee: Waagner-Biro A.G., Austria

[21] Appl. No.: 267,337

[22] Filed: May 26, 1981

[30] Foreign Application Priority Data

May 30, 1980 [AT] Austria ..... 2875/80

[51] Int. Cl.[3] ..... F26B 5/00

[52] U.S. Cl. ..... 34/20; 34/168; 122/27; 165/DIG. 6; 432/85

[58] Field of Search ..... 34/20, 168, 177; 122/27; 165/DIG. 6; 432/85

[56] References Cited

U.S. PATENT DOCUMENTS 1,624,602 4/1927 Jacobus et al. ..... 122/27

1,836,402 12/1931 Schumacher ..... 122/27

2,641,849 6/1953 Lintz ..... 34/177

3,705,620 12/1972 Kayatz ..... 34/177

*Primary Examiner*—Larry I. Schwartz

*Attorney, Agent, or Firm*—Steinberg & Raskin

[57] ABSTRACT

Method and apparatus for cooling hot bulk material, such as red-hot coke, sinter, or clinker, and, in particular, for relieving a gas stream flowing through the hot bulk material to cool the same includes continuously charging hot bulk material into a cooler housing and onto the free surface of spread bulk material already contained within the cooler housing and cooling the hot bulk material by absorbing and removing the intensive heat radiation radiated from the surface of the hot bulk material in a radiation cooling surface extending over in facing relationship to the free surface of hot bulk material.

9 Claims, 5 Drawing Figures

METHOD AND INSTALLATION FOR COOLING HOT BULK MATERIAL

BACKGROUND OF THE INVENTION

This invention relates generally to methods and apparatus for cooling hot bulk material and, in particular, to methods and apparatus for cooling hot bulk material wherein a gas stream flowing through the hot bulk material to cool the same is relieved.

Cooling hot bulk material by passing a gas stream therethrough is a known technique. Such a technique, however, has the disadvantage that the cooling gas while passing through the hot bulk material to cool the same often itself becomes heated to an extent such that overheating of the cooling surfaces becomes a possibility.

SUMMARY OF THE INVENTION

Accordingly, one object of the present invention is to provide new and improved methods and apparatus for cooling hot bulk materials.

A primary object of the present invention is to provide a new and improved method and apparatus for cooling hot bulk materials wherein the gas stream flowing through the hot bulk material to cool the same is relieved, i.e., the extent to which the temperature of the gas stream flowing through the hot bulk material increases is reduced.

According to the method of the present invention, hot bulk material is continuously charged into a cooler onto the free surface of spread bulk material therewith whereupon the hot bulk material is cooled by absorbing and removing the intensive heat radiation radiated from the surface of the hot bulk material in radiation cooling surfaces and whereupon the partially cooled bulk material is further cooled by passing a gas stream through the same either during the radiation cooling step or subsequent thereto. The hot bulk material may initially be cooled to a temperature less than the ignition temperature through said absorption of radiant heat and subsequently be cooled to a temperature proximate to ambient temperature by passing the gas stream therethrough. When the gas stream constitutes an oxygen containing gas, the same may be advantageously used after it has passed through the hot bulk material as preheated combustion gas. In one preferred embodiment of the method, the absorption and removal of the intensive heat radiation from the surface of the hot bulk material is effected in a pre-cooling chamber which precedes a gas treatment zone in which the further cooling is effected through passage of a gas stream through the hot bulk material.

According to the apparatus of the present invention, a radiation cooling surface extends over in facing relationship to the free surface of hot bulk material contained within a cooler housing which is adapted to continuously receive a charge of additional hot bulk material onto the free surface of spread bulk material already contained within the cooler housing. Below the radiation cooling surface in the direction of flow of the bulk material is a gas stream cooling installation whereby a gas stream is passed through the hot bulk material to further cool the same. The gas stream exits from the hot bulk material and cooler housing below the radiation cooling surface and preferably separated therefrom by a layer of hot bulk material.

DESCRIPTION OF THE DRAWINGS

A more complete appreciation of the present invention and many of the attendant advantages thereof will be readily appreciated as the same becomes better understood by reference to the following detailed description when considered in connection with the accompanying drawings in which.

DESCRIPTION OF THE PREFERRED EMBODIMENTS

Figure 1:
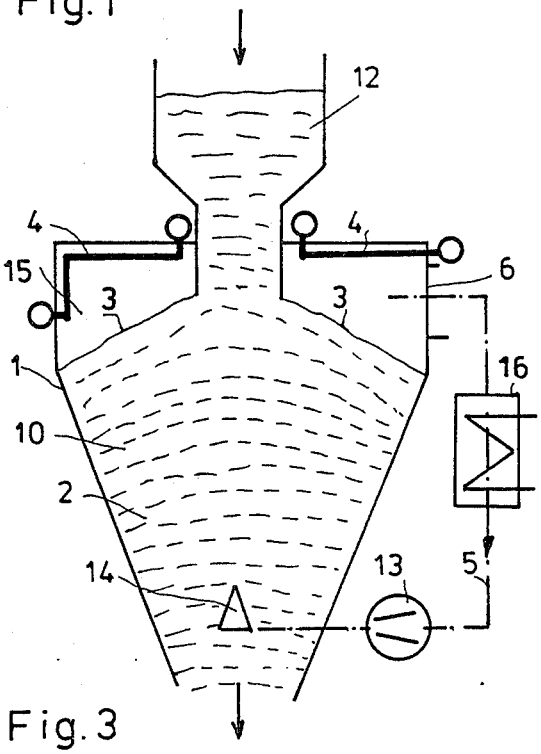
FIG. 1 is a schematic elevation view of a conical cooler according to the present invention.

Referring now to the drawings wherein like reference characters designate identical or corresponding parts throughout the several views and, more particularly, to FIG. 1, a conical shaped cooler or bunker 1 is illustrated into which hot bulk material is charged through a central funnel 12 and continuously drawn off through a discharge at the underside of the cooler. Thus, as bulk material is continuously drawn from within the conical cooler, the free surface 3 of the bulk material descends within the cooler so that fresh hot bulk material can be charged thereonto through the central funnel 12.

One or more radiation cooling surfaces 4 are provided within the cooler 1 at a location so as to be in facing relationship to the free surface of the hot bulk material. The radiation cooling surfaces 4 absorb and remove the intensive heat radiation radiated from the bulk material surface 3.

In order to further enhance the cooling of the hot bulk material, a gas cooling installation is provided by means of which a cold cooling gas stream passes through the bulk material. More particularly, the gas installation includes a blower 13 which directs cold cooling gas into a gas distribution device 14 located within the cooler and through which the cooling gas is distributed into the hot bulk material to pass therethrough. The cooling gas thus flows upwardly through the layers of hot bulk material and is collected in an annular space 15 above the bulk material surface 3 from where it discharges via an outlet 6. The heated cooling gas can then be supplied to a recooling device 16 such as a heat exchanger in a steam generating plant.

Figure 2:
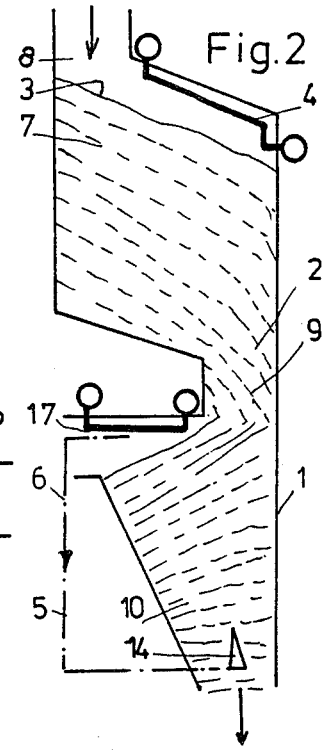
FIG. 2 is a schematic elevation view of a cooler according to the present invention including a pre-cooling chamber and gas treatment zone.

Referring now to FIG. 2, another embodiment of the apparatus of the present invention is illustrated wherein the cooler 1 is constituted by a housing which includes a pre-cooling chamber 7 having an inlet 8 and an outlet 9 and, further, a gas treatment zone 10 formed separately from the pre-cooling chamber 7. In the illustrated embodiment, the radiation cooling surface 4 is situated proximate to the inlet 8 to the pre-cooling chamber 7 and the hot bulk material is only cooled by the radiation cooling surface 4 in pre-cooling chamber 7. The discharge or outlet 9 from the pre-cooling chamber 7 constitutes a constriction formed in the cooler housing through which bulk material is supplied to the gas treatment zone 10. A cooling gas installation is provided in the gas treatment zone 10 whereby a gas stream passes through the hot bulk material contained therein and exits therefrom at a gas discharge 6. It is seen that the temperature of the cooling gas at discharge 6 would be significantly lower than the case wherein the pre-cooling chamber 7 is not utilized so that in this manner overheating of the gas line can be reliably avoided.

It is also noted that in the embodiment illustrated in FIG. 2, a radiation cooling surface 17 similar to radiation cooling surface 4 is provided in the area proximate to the gas discharge 6 whereby the increase in temperature of the cooling gas during passage through the hot bulk material can be further reduced.

Figure 3:
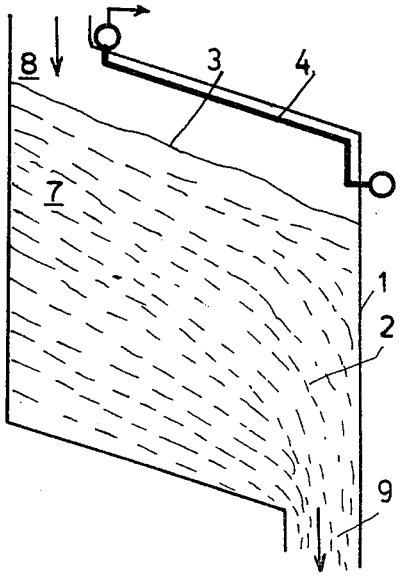
FIG. 3 is a schematic elevation view of a cooler which does not include a gas cooling installation.

Referring now to the embodiment illustrated in FIG. 3, a receiver 7 for the bulk material is illustrated on a larger scale. In this embodiment, the cooling of the bulk material is so intense that the bulk material can be cooled to an extent such that the same can be stored or conveniently transported. In other words, the cooling effected by the radiation cooling surface 4 is sufficient that a gas cooling installation is not required.

The embodiments of the invention illustrated in connection with FIGS. 1–3 are especially suitable for the cooling of red-hot coke, clinker or sinter material.

Figure 4:
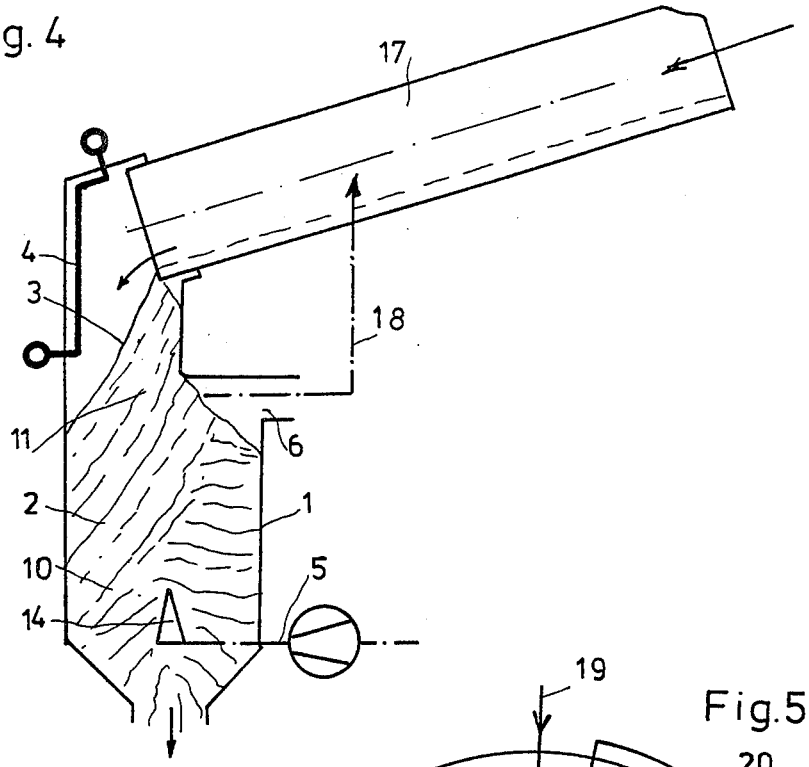
FIG. 4 is a schematic elevation view of a cooler according to the present invention adapted to cooperate with a rotary tube furnace.

Referring to FIG. 4, cooling apparatus for cooling carbon-containing bulk material which has been heated in a rotary tube furnace 17 is illustrated. A radiation cooling surface 4 is provided at a location where the bulk material exits from the rotary tube furnace 17 into the cooler 1. The heat radiation radiating from the surface 3 of the bulk material is removed in a continuous manner by it being absorbed in the radiation cooling surface 4. In this manner, the temperature of the hot bulk material is reduced to an extent such that even if the gas stream utilized in the gas treatment zone 10 constitutes an oxygen containing gas, the bulk material will not ignite. The heated oxygen containing cooling gas stream can then be directed to the rotary tube furnace 17 via line 18 and there be used as combustion air from the carbon contained in the bulk material.

Figure 5:
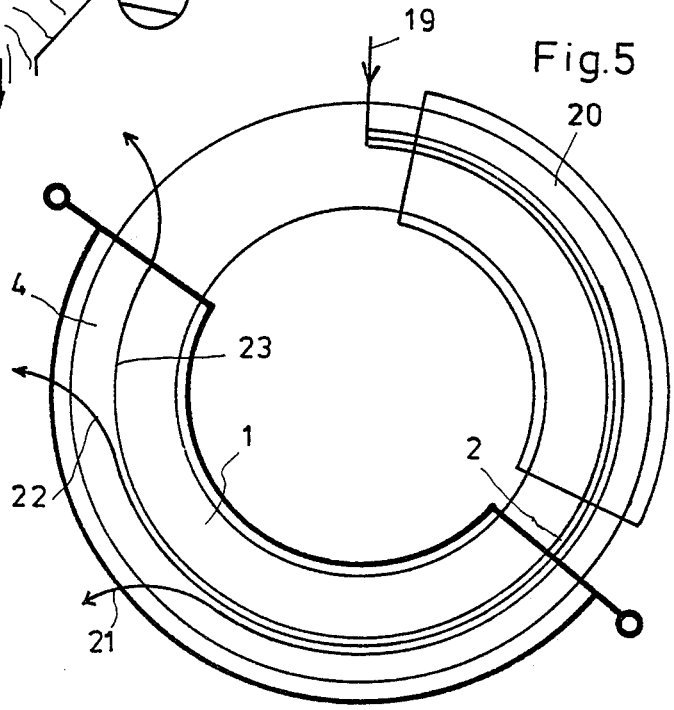
FIG. 5 is a schematic view of a trough-type tunnel furnace having a cooling section.

Finally, turning to FIG. 5, the present invention is illustrated in the context of an annular hearth coking installation. The material to be coked is charged into the annular hearth at 19. The material is heated and coked in the coking installation 20 and finally supplied to the cooler 1 in which an uppermost layer is cooled by the radiation cooling surface 4. The topmost layer is removed by a scraping device as designated by arrow 21 after cooling is completed whereupon the middle layer is then exposed to the intensive cooling effected by the radiation cooling surface, the middle layer then being removed according to arrow 22. Finally, in the last part of the cooler the bottom layer 23 is cooled through exposure to the radiant cooling surface 4 and then removed from the hearth.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. A method for cooling hot bulk material, such as red-hot coke, sinter, or clinker, in a cooler into the housing of which the hot bulk material is charged so as to define a free surface of spread bulk material therewithin, and in particular, for reducing the temperature to which a cooling gas stream flowing through the hot bulk material would otherwise be increased during its flow through the hot bulk material, comprising the steps of:

providing a radiation cooling surface within the cooler housing positioned in substantially opposed, spaced and non-contacting relation with respect to the free surface of spread bulk material;

charging additional hot bulk material into the cooler housing onto the free surface of spread bulk material already within the cooler so as to define a new free surface of spread bulk material therewithin which is in substantially opposed, spaced and non-contacting relation with the radiation cooling surface;

initially cooling the hot bulk material by absorbing and removing the radiant heat radiated from the free surface of the hot bulk material in the radiation cooling surface, substantially without the transfer of convective heat from the bulk material to the radiation cooling surface; and substantially further cooling the initially cooled bulk material by passing a cooling gas stream through the same;

whereby the temperature to which the cooling gas stream is increased during its flow through the initially cooled hot bulk material is reduced relative to the temperature to which it would have otherwise been increased in the absence of said initial cooling step.

2. The method of claim 1 wherein the gas stream is passed through the initially cooled bulk material situated in the cooler housing and at the same time as the heat radiation radiated from the free surface of the hot bulk material is absorbed on the radiation cooling surfaces.

3. The method of claim 1 wherein the hot bulk material is initially cooled during said initial cooling step to a temperature less than the ignition temperature thereof by said absorbing and removing of radiant heat and is subsequently cooled during said subsequent cooling step to a temperature proximate to ambient temperature by the cooling gas stream passing therethrough.

4. The method of claim 3 wherein the gas stream constitutes an oxygen containing gas.

5. The method of claim 4 wherein the oxygen containing gas stream is used as preheated combustion gas after it has passed through the hot bulk material.

6. The method of claim 1 wherein the absorbing and removal of the intensive heat radiation from the surface of the hot bulk material is effected in a pre-cooling chamber which precedes a gas treatment zone in which the further cooling is effected by passing a gas stream through the hot bulk material contained therein and wherein hot bulk material is fed from the pre-cooling chamber into the gas treatment zone.

7. Cooler apparatus for cooling hot bulk material, such as red-hot coke, sinter, or clinker, and in particular, for reducing the temperature to which a cooling gas stream flowing through the hot bulk material would otherwise be increased during its flow through the hot bulk material, comprising:

a cooler housing adapted to contain hot bulk material which travels therethrough and so as to present a free surface of spread bulk material therewithin and to receive additional hot bulk material as the same is charged thereinto onto the free surface of spread bulk material already within the cooler housing so as to present a new free surface of spread bulk material;

radiation cooling surface means extending over the free surface of the hot bulk material in substantially opposed, spaced and non-contacting relation for initially cooling the bulk material by absorbing and removing the radiant heat radiated from the free surface of the bulk material, substantially without the transfer of convective heat from the bulk material to the radiation cooling surface; and means for passing a gas stream through the initially cooled hot bulk material to subsequently further cool the same and so that the gas stream exits from the bulk material and cooler at a region below said radiation cooling surface;

whereby the temperature to which the cooling gas stream is increased during its flow through the initially cooled hot bulk material is reduced relative to the temperature to which it would have otherwise been increased in the absence of said initial cooling.

8. The combination of claim 7 wherein the point of exit of the gas stream from the bulk material and said radiation cooling surface are mutually separated from each other by a layer of hot bulk material.

9. The combination of claim 7 wherein said cooler housing includes a pre-cooling chamber including a inlet and an outlet, said radiation cooling surface being situated proximate to said inlet and said outlet being constituted by a constriction through which the bulk material is supplied to a gas treatment zone included in said housing.

* * * * *